US007926493B2

(12) United States Patent
Schock

(10) Patent No.: US 7,926,493 B2
(45) Date of Patent: Apr. 19, 2011

(54) DEVICE INCORPORATING A CHAMBER THROUGH WHICH FLUID IS ADAPTED TO FLOW AND THE USE OF A DRAWER GUIDE IN SUCH A DEVICE

(75) Inventor: Martin Schock, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 0 days.

(21) Appl. No.: 12/590,783

(22) Filed: Nov. 12, 2009

(65) Prior Publication Data

US 2010/0108109 A1 May 6, 2010

Related U.S. Application Data

(62) Division of application No. 10/754,460, filed on Jan. 9, 2004, now Pat. No. 7,640,612.

(51) Int. Cl.
*A47L 15/50* (2006.01)

(52) U.S. Cl. ..... 134/85; 134/56 D; 134/82

(58) Field of Classification Search ..... 134/85
See application file for complete search history.

(56) References Cited

U.S. PATENT DOCUMENTS

| | | | | |
|---|---|---|---|---|
| 5,061,020 | A | 10/1991 | Ulrich | |
| 6,565,170 | B2 | 5/2003 | Banicevic et al. | |
| 2004/0085006 | A1 * | 5/2004 | Shinchi et al. | 312/228 |

FOREIGN PATENT DOCUMENTS

| | | | |
|---|---|---|---|
| DE | 44 32 821 | | 3/1996 |
| DE | 4 02 08 286.9 | | 10/2002 |
| DE | 102 48 512 | | 4/2004 |
| EP | 0768050 | * | 4/1997 |
| FR | 1 592 191 | | 5/1970 |
| JP | 2000-254087 | * | 9/2000 |
| JP | 200254087 | | 9/2000 |

* cited by examiner

*Primary Examiner* — Michael Barr
*Assistant Examiner* — Jason P Riggleman
(74) *Attorney, Agent, or Firm* — Lipsitz & McAllister, LLC

(57) ABSTRACT

A drawer guide is provided for a dishwasher or other device through which there is a flow of liquid or gas. The drawer guide has guide rails and at least one rolling member assembly to guide the guide rails in a displaceable manner on another guide rail. A cage is provided for the rolling members. At least one of the guide rails has a rear rail portion with fluid passage openings that allow liquid or gas to flow through the guide rail when the device is in operation. At least one cage for the rolling members of the drawer guide can include a rear cage portion that is provided with fluid passage openings that allow liquid or gas to flow therethrough when the device is in operation.

22 Claims, 8 Drawing Sheets

Figure 1:
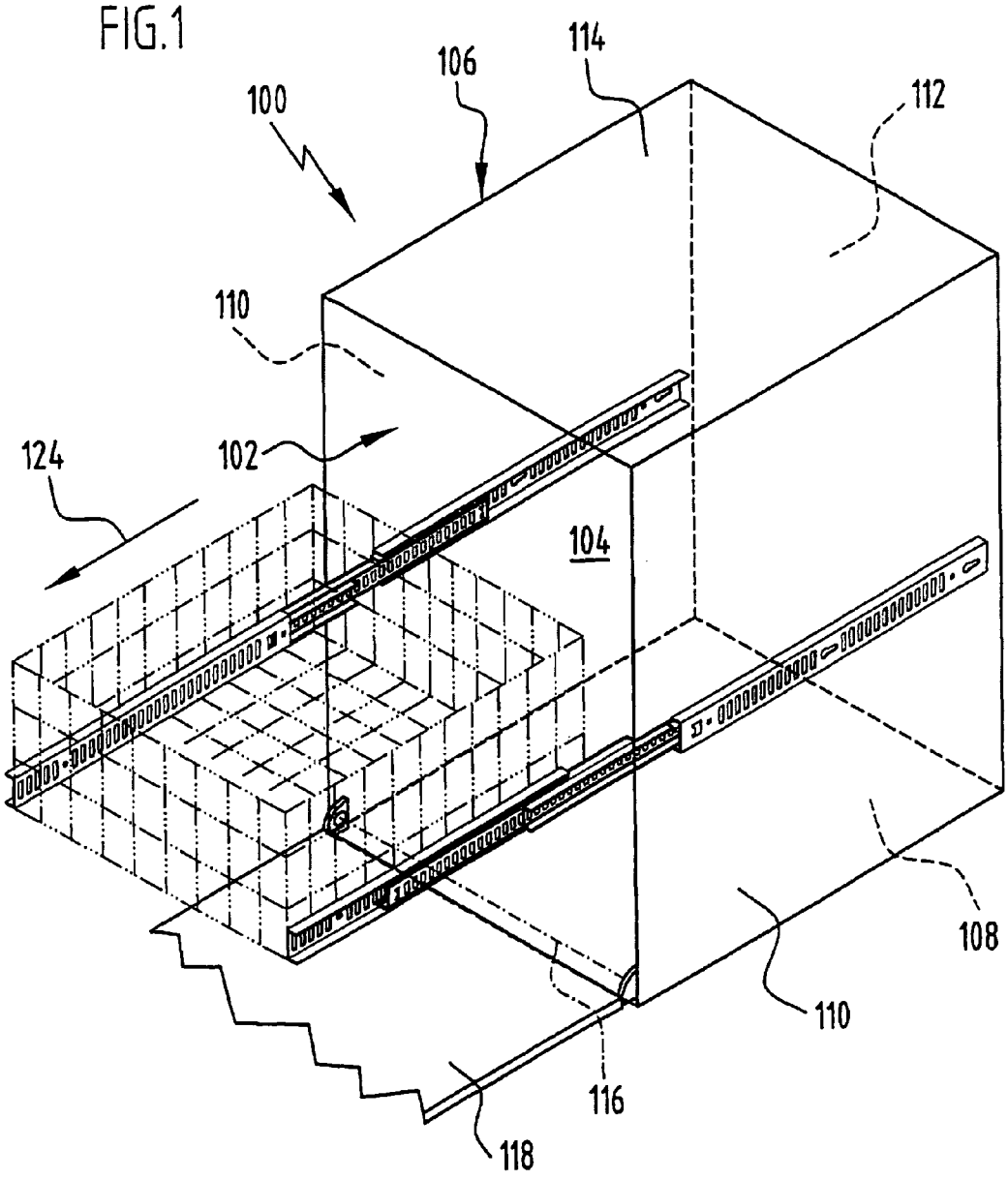

122
136
138
124
140
142

DEVICE INCORPORATING A CHAMBER THROUGH WHICH FLUID IS ADAPTED TO FLOW AND THE USE OF A DRAWER GUIDE IN SUCH A DEVICE

This application is a divisional of U.S. patent application Ser. No. 10/754,460, filed on Jan. 9, 2004, now U.S. Pat. No. 7,640,612 which is incorporated herein and made a part hereof by reference.

The present invention relates to a device incorporating a chamber through the interior of which, at least on occasion, there is a flow of liquid or of a gas at an elevated pressure when the device is in operation, wherein the device comprises at least one drawer and at least one drawer guide by means of which the drawer is held on a corpus of the chamber such that it is displaceable in the direction of movement of the drawer.

Such devices are known from the state of the art.

In particular, dishwashers are known which incorporate a rinsing chamber through the interior of which there is a flow of a rinsing liquid (water together with cleaning additives) at least on occasion when the device is in operation, wherein the dishwasher comprises at least one drawer in the form of a table-ware basket for holding the articles which are to be cleaned. The drawer is withdrawable from the rinsing chamber and in so doing is guided on a pair of withdrawable guide rails by means of rollers.

In the case of these devices, it is a disadvantage that guiding the drawer on the extendable guide rails by means of the rollers is a cumbersome operation and not very precise, and the guide rails also tend to be pulled out from the interior of the rinsing chamber in an uneven manner, this thereby resulting in the drawer being slightly tilted as it is being withdrawn. Furthermore, in operation of the device, the dirt that is rinsed off the articles being cleaned is deposited on the running tracks of the guide rails where it is compacted by the rollers guiding the drawer, this thus impairing the running attributes of the rollers on the running tracks.

Consequently, the object of the present invention is to produce a device of the type mentioned hereinabove which enables precise and smooth-running guidance of the drawer during movements thereof within the interior or when pulling it out of the interior or when pushing it into the interior of the chamber even after extended operation of the device.

In accordance with the invention, this object is achieved in that the drawer guide comprises at least one guide rail at the drawer side and one guide rail at the corpus (i.e., chamber) side and at least one rolling member assembly by means of which one of the guide rails is guided in displaceable manner on another guide rail of the drawer guide in the direction of movement of the drawer and which comprises a cage for the rolling members, wherein

- at least one of the guide rails of the drawer guide comprises a rear rail portion which includes at least one partial section that extends in the direction of movement of the drawer and is provided with fluid passage openings in such a manner that the liquid or the gas is adapted to flow through the guide rail concerned when the device is in operation, and/or
- at least one cage for the rolling members of the drawer guide comprises a rear cage portion which includes at least one partial section that extends in the direction of movement of the drawer and is provided with fluid passage openings in such a manner that the liquid or the gas is adapted to flow through the cage for the rolling members when the device is in operation.

Here, the rear rail portion of a guide rail is to be understood as being the web which connects the two running tracks for the rolling members of the guide rail. The rear cage portion of a cage for the rolling members is to be understood as being the web which connects the two rolling member retaining strips of the cage for the rolling members.

In this description and in the accompanying Claims, a "drawer" is to be understood as being any element which is movable within the chamber or out of the chamber or into the chamber by a relative displacement of the guide rails.

In this description and in the accompanying Claims, a "drawer guide" is to be understood as being any device with which at least two guide rails are held such as to be displaceable relative to one another; it is irrelevant here as to whether one of the guide rails is pulled out of the other one or not.

The direction of movement of the drawer can, in principle, be arbitrarily aligned, in particular, substantially horizontally or substantially vertically.

The gas at an elevated pressure can be any gas or gas mixture which is subjected to a pressure that is higher relative to the ambient pressure, for example, the air in a compressed-air jet.

Thus, the concept underlying the solution in accordance with the invention is the use of a drawer guide incorporating guide rails mounted on rolling members for guiding the drawer, such a drawer guide enabling particularly precise and smooth-running guidance of the drawer during the movement thereof within the interior of the chamber or when pulling it out of the interior or when pushing it into the interior of the chamber of the device.

Due to the fluid passage openings provided in the rear rail portions of the guide rails and/or in the rear cage portions of the cage for the rolling members, through which said openings the liquid or the gas flowing through the chamber can enter the drawer guide and then depart from the drawer guide, it is thereby ensured that the drawer guide, and in particular, the running tracks thereof for the rolling members, will not be subjected to deposits of dirt particles and thus become unusable, but rather, that they will be flushed through by this liquid or the gas with as little hindrance as possible and, to a large extent, be kept free of dirt deposits by virtue of this flushing action.

This concept underlying the invention is very surprising since it would seem much more obvious to prevent contamination of the running tracks of the drawer guide by shielding the interior of the drawer guide to as large an extent as possible from the penetration of liquid or gas from the interior of the chamber in order to thereby prevent the ingress of the dirt particles which are rinsed off the articles being cleaned in the interior of the chamber by the liquid or the gas. Unexpectedly however, it has now been established that the penetration of liquid or gas into the drawer guide, even if the liquid or gas is loaded with dirt particles, is not harmful to the normal functioning of the drawer guide, as long as it is ensured that the liquid or the gas together with the dirt particles carried therein can stream out of the drawer guide again with as little hindrance as possible. In this way, dirt particles are prevented from collecting in the drawer guide, and in particular, on the bearing surfaces of the rolling members, which action could impair the normal functioning of the drawer guide.

In the device in accordance with the invention, provision is made for at least one of the guide rails and/or at least one cage for the rolling members to be provided with the fluid passage openings.

A particularly good volume of flow through the drawer guide is achieved if all the guide rails of the drawer guide and/or all the cages for the rolling members of the drawer guide are provided with such fluid passage openings.

It is particularly expedient if all of the guide rails and also all of the cages for the rolling members of the drawer guide are provided with such fluid passage openings.

Insofar as further add-on elements are present in addition to the guide rails and the cages for the rolling members, then these should also be designed such as to be as through-flow-friendly as possible in order to present as little impedance as possible to the flow of fluid or the flow of gas through the drawer guide, or even if they were to assist this process, this being possible, in particular, if a fluid jet or a compressed gas jet that is produced in the interior of the chamber of the device is deliberately directed towards the fluid passage openings in the drawer guide by appropriate design of the add-on elements.

Experiments with dishwashers have confirmed that for the efficient washing of residual substances and in particular dirt particles out of the drawer guide, it is expedient if the ratio of the surface area of the fluid passage openings in the guide rail to the total surface area of the rear rail portion (including the surface area of the fluid passage openings) in the partial section that is provided with the fluid passage openings amounts to at least approximately 20%.

If the fluid passage openings are provided in the rear cage portion of a cage for the rolling members, then it has proved to be expedient if the ratio of the surface area of the fluid passage openings in the cage for the rolling members to the total surface area of the rear cage portion (including the surface area of the fluid passage openings) in the partial section that is provided with the fluid passage openings amounts to at least approximately 20%.

The cleaning efficiency of the liquid or of the gas passing through the drawer guide becomes greater with increasing throughput of liquid and/or increasing throughput of gas through the drawer guide.

Consequently, it is particularly expedient if the ratio of the surface area of the fluid passage openings in the guide rail to the total surface area of the rear rail portion (including the surface area of the fluid passage openings) in the partial section that is provided with the fluid passage openings amounts to at least approximately 25%, preferably to at least approximately 30%, and especially to at least approximately 40%.

As an alternative or in addition thereto, it is particularly expedient if the ratio of the surface area of the fluid passage openings in the cage for the rolling members to the total surface area of the rear cage portion (including the surface area of the fluid passage openings) in the partial section that is provided with the fluid passage openings amounts to at least approximately 25%, preferably to at least approximately 30%, and especially to at least approximately 40%.

On the other hand, the ratio of the surface area of the fluid passage openings to the total surface area of the rear rail portion or to that of the rear cage portion should not be too large so as to ensure adequate mechanical stability of the drawer guide.

The upper limit for the ratio of the surface area of the fluid passage openings consistent with maintaining adequate mechanical stability of the drawer guide depends, in particular, upon the geometry of the guide rail profiles, on the materials used, on the loading, on the relationship between the overall length and the length of withdrawal of the drawer guide and on the linkage between the drawer guide and the environment, i.e. in particular, on the type of attachment of the drawer guide to the boundary walls of the chamber.

In order to obtain adequate mechanical stability of the drawer guide, it has proved to be expedient if the ratio of the surface area of the fluid passage openings in the guide rail to the total surface area of the rear rail portion (including the surface area of the fluid passage openings) in the partial section that is provided with the fluid passage openings amounts to at most approximately 90%, and preferably to at most approximately 80%.

As an alternative or in addition thereto, it is of advantage if the ratio of the surface area of the fluid passage openings in the cage for the rolling members to the total surface area of the rear cage portion (including the surface area of the fluid passage openings) in the partial section that is provided with the fluid passage openings amounts to at most approximately 90%, and preferably to at most approximately 80%.

In particular, a framework structure can be introduced into the rear rail portion and/or into the rear cage portion which will be such as to permit optimal flushing characteristics under the given mechanical boundary conditions.

The fluid passage openings can, in principle, be produced using any arbitrary procedure which allows the material of the passage openings to be separated away from the surrounding material.

In particular, provision may be made for the fluid passage openings to be inserted into the rear rail portion or the rear cage portion by a punching process.

However, in order to enable particularly high aperture ratios to be obtained without giving rise to distortions in the guide rail or in the cage for the rolling members, it is expedient for the fluid passage openings to be produced in the guide rail or in the cage for the rolling members by means of a force-free separation process.

In particular, provision may be made for the fluid passage openings to be inserted into the guide rail or into the cage for the rolling members by means of a laser cutting process.

By virtue of such a laser cutting process, ratios falling within the range of approximately 80% to approximately 90% for the surface areas of the fluid passage openings are easily attainable.

Instead of forming the fluid passage openings in the rear rail portion or in the rear cage portion by a removal process, provision could also be made for the rear rail portion or the rear cage portion to be formed with the desired fluid passage openings from the very beginning, for example, by means of a casting process (in particular a synthetic material injection moulding process), or by assembling the rear rail portion or the rear cage portion from a plurality of components in such a way that gaps formed between the assembled components result in the desired fluid passage openings.

In order to obtain as high a throughput of liquid or as high a throughput of gas as possible through the drawer guide, it is of advantage if at least one of the partial sections provided with fluid passage openings extends over at least one third of the length of the rear rail portion or over at least one third of the length of the rear cage portion.

Furthermore, it is expedient if the sum of the lengths of the partial sections of the rear rail portion or those of the rear cage portion that are provided with fluid passage openings is greater than approximately two thirds of the total length of the rear rail portion or the rear cage portion.

It is particularly expedient if the entire rear rail portion or the entire rear cage portion forms just a single partial section provided with fluid passage openings, in which the previously mentioned ratios of the surface areas of the fluid passage openings are achieved.

Thus, in this case, the ratio of the surface area of the fluid passage openings in the guide rail to the total surface area of the rear rail portion (including the surface area of the fluid passage openings) amounts to at least approximately 20%, preferably to at least approximately 25%, especially to at least approximately 30%, and most especially to at least approximately 40%.

In this case, as an alternative or in addition thereto, the ratio of the surface area of the fluid passage openings in the cage for the rolling members to the total surface area of the rear cage portion (including the surface area of the fluid passage openings) amounts to at least approximately 20%, preferably to at least approximately 25%, especially to at least approximately 30%, and most especially to at least approximately 40%.

Basically, it is of advantage if the fluid passage openings extend as closely as possible to the running tracks for the rolling members of the guide rails so that, on the one hand, there will be as low a loss of flow power within the drawer guide as possible, whence the fluid jet or the compressed gas jet will hit the residues that are to be cleared away with as high an energy as possible and thus rinse them away, and so that, on the other hand, no dead water zones will develop within the running tracks for the rolling members wherein liquid residues or rinsing residues can collect.

Consequently, it is of advantage if at least one partial section of a guide rail of the drawer guide comprises fluid passage openings whose lateral distance from at least one of the lateral edges of the rear rail portion of the guide rail concerned is less than approximately a quarter of the width of the rear rail portion.

The drawer guides may be built into the chamber such as to be standing (i.e. with vertically aligned rear rail portions) as well as lying (i.e. with horizontally aligned rear rail portions). The optimal situation in the installation depends on the selected dimensions of the rails, on the materials employed and on the loads imposed thereon.

If the drawer guide is built-in such as to be standing, then this is particularly expedient for the run-off of the liquid from the drawer guide if at least one partial section of a guide rail of the drawer guide comprises fluid passage openings having a lower edge whose distance from a lower edge of the rear rail portion of the guide rail concerned is less than approximately a quarter of the width of the rear rail portion.

Here, the width of the rear rail portion is to be understood as being the extent of the rear rail portion in a direction perpendicular to the direction of movement of the drawer.

In the case of a preferred embodiment of the device in accordance with the invention, provision is made for the respective partial section of the rear rail portion or of the rear cage portion that is provided with the fluid passage openings to comprise at least three substantially mutually congruent fluid passage openings.

Since, in the case of preferred embodiments of the device in accordance with the invention, the drawer guide comprises a plurality of elements (guide rails and cages for the rolling members) which are displaceable relative to one another and are each provided with fluid passage openings whereby the fluid passage openings in the different elements are aligned with one another in certain positions of the drawer guide whilst they are displaced relative to one another in other positions of the drawer guide, then, in principle, there is a danger that operating personnel, and in particular children, will insert one or more fingers into the mutually aligned fluid passage openings and that the finger or the fingers will be crushed in the course of a subsequent relative displacement of the elements of the drawer guide.

In order to obviate this danger, it is of advantage if the extent of each one of the fluid passage openings in the rear rail portion or in the rear cage portion of the drawer guide is at most approximately 5 mm in at least one of the directions in which it extends. Such fluid passage openings would then be too small for one let alone a plurality of fingers to be stuck into the mutually aligned fluid passage openings.

It has proved to be particularly expedient if the extent of each of the fluid passage openings in the rear rail portion or in the rear cage portion is at most approximately 5 mm in the direction of movement of the drawer.

In order to obstruct the flow of the liquid or the gas through the drawer guide as little as possible, provision is made in a preferred embodiment of the device in accordance with the invention for at least one guide rail of the drawer guide and at least one cage for the rolling members of the same drawer guide to be provided with fluid passage openings.

In order to ensure perfect flushing of the drawer guide, it has proved to be particularly expedient if, in a state of the drawer guide in which it is pushed completely into the interior of the chamber, at least one fluid passage opening in the guide rail and at least one fluid passage opening in the cage for the rolling members are aligned with one another.

Here, "alignment" of two adjacent fluid passage openings in different elements of the drawer guide is to be understood as being any situation, in which the fluid passage opening in the one element substantially completely covers the pertinent fluid passage opening in the other element (as seen in a direction running perpendicularly relative to the direction of movement of the drawer). For the purposes of "alignment" in this sense, it is not necessary for the boundary lines of the two fluid passage openings that are associated with one another to coincide with one another.

For perfect flushing of the drawer guide it is expedient, if, in a state of the drawer guide in which it is pushed completely into the interior of the chamber, a plurality of fluid passage openings in the guide rail are aligned with a respective fluid passage opening in the cage for the rolling members.

It is particularly expedient, if, in a state of the drawer guide in which it is pushed completely into the interior of the chamber, substantially all of the fluid passage openings in the guide rail are aligned with a respective fluid passage opening in the cage for the rolling members.

In order to produce turbulences in the flowing liquid or the gas which are effective to dislodge dirt particles in the drawer guide, it can also be of advantage if, in the state of complete insertion into the interior of the chamber, the edges of the fluid passage openings of neighbouring elements of the drawer guide (guide rails or cages for the rolling members) are mutually displaced in the direction of movement of the drawer in such a manner that a respective one of the elements partly, but not completely, covers the fluid passage openings in the other respective element. In this way, the effect is achieved that the liquid or the gas can enter each region of the drawer guide and that obstacles are formed in the path of the liquid or the gas by the displaced edges, thereby producing the desired turbulences.

In order to enable the residual liquid to run off the rolling member running track of a guide rail in the drawer guide, it is of advantage if at least one guide rail of the drawer guide comprises a running track for the rolling members which is provided with at least one fluid passage opening.

Since the presence of such fluid passage openings in the rolling member running track could have negative effects on the running attributes of the rolling members in the rolling member running track, it is expedient if the rolling member running track is provided with one or with a plurality of fluid passage openings in only one end region or in both end regions thereof.

A certain latching effect for the rolling members in the maximally withdrawn position of the drawer guide can also be obtained by virtue of the fluid passage openings provided in an end region of the rolling member running track.

In the case of a preferred embodiment of the device in accordance with the invention, provision is made for at least one rolling member assembly of the drawer guide to comprise rolling members in the form of balls or in the form of spherical rollers which only touch the rolling member running track along a line.

It is particularly expedient, if at least one rolling member assembly of the drawer guide comprises rolling members which are each in single-point contact with a rolling member running track of a guide rail of the drawer guide associated with the rolling members. By virtue of such a single-point contact of the rolling member with the associated rolling member running track, there thus ensues a snow plough effect, i.e. the rolling member furrows through possibly existing deposits on the rolling member running track and displaces dirt that may possibly have accumulated on the rolling member running track to the side away from the rolling member running track. A self cleaning effect of the rolling member running track is obtained in this way.

As an alternative to the rolling members resting on the rolling member running track in single-point manner, provision could also be made for the rolling members to rest on the rolling member running track at two positions which are spaced from one another in a direction transverse to the direction of movement of the drawer. In this case in particular, the region of the rolling member running track lying between the contact positions can be provided with fluid passage openings so that dirt can be washed off the rolling member running track through these fluid passage openings.

The drawer guide of the device in accordance with the invention may be in the form of a two-piece partial drawer guide, i.e. comprise only the guide rail at the drawer side and the guide rail at the corpus side.

However, provision may also be made for the drawer guide to be formed of at least three parts and thus for it to comprise at least one further guide rail in addition to the guide rail at the drawer side and the guide rail at the corpus side, said further guide rail being arranged between the drawer side guide rail and the corpus side guide rail.

Such a drawer guide may, for example, be in the form of a multiple drawer guide arrangement (two coupled partial drawer guides) or in the form of a telescopic drawer guide arrangement (having a guide rail at the corpus side, a middle guide rail that is displaceable relative thereto and a drawer-side guide rail that is displaceable in the middle guide rail).

In order to make the drawer located in the interior of the chamber as easily accessible as possible for the purposes of loading or unloading it, it is of advantage if the drawer guide is in the form of a full withdrawl guide with the aid of which the drawer is withdrawable substantially completely from the interior of the chamber.

In particular, the device in accordance with the invention may be in the form of a dishwasher or a washing machine.

In principle however, other embodiments of the device in accordance with the invention also come into consideration, for example, in the form of a disinfecting device, a sterilizing device, flow equipment or the like, i.e. any of those devices which comprise a chamber through which there is at least an occasional flow of liquid during the operation of the device.

One embodiment is directed toward the use of a drawer guide which comprises at least one guide rail at the drawer side and one guide rail at the corpus side and at least one rolling member assembly by means of which the drawer side guide rail is guided in displaceable manner on the corpus side guide rail or on another guide rail of the drawer guide in the direction of movement of the drawer and which comprises a cage for the rolling members, wherein at least one of the guide rails of the drawer guide comprises a rear rail portion which includes at least one partial section that extends in the direction of movement of the drawer and is provided with fluid passage openings in such a manner that a liquid or a gas is adapted to flow through the guide rail concerned, and/or at least one cage for the rolling members of the drawer guide comprises a rear cage portion which includes at least one partial section that extends in the direction of movement of the drawer and is provided with fluid passage openings in such a manner that a liquid or a gas is adapted to flow through the cage for the rolling members, for the purposes of holding a drawer in displaceable manner on a corpus of a chamber in a device through the interior of which, at least on occasion, there is a flow of liquid or of a gas at an elevated pressure when the device is in operation.

The advantages of such a use of such a drawer guide have already been described hereinbefore in connection with the device in accordance with the invention.

Further features and advantages of the invention form the subject matter of the following description and the sketched illustration of an exemplary embodiment.

Figure 2:
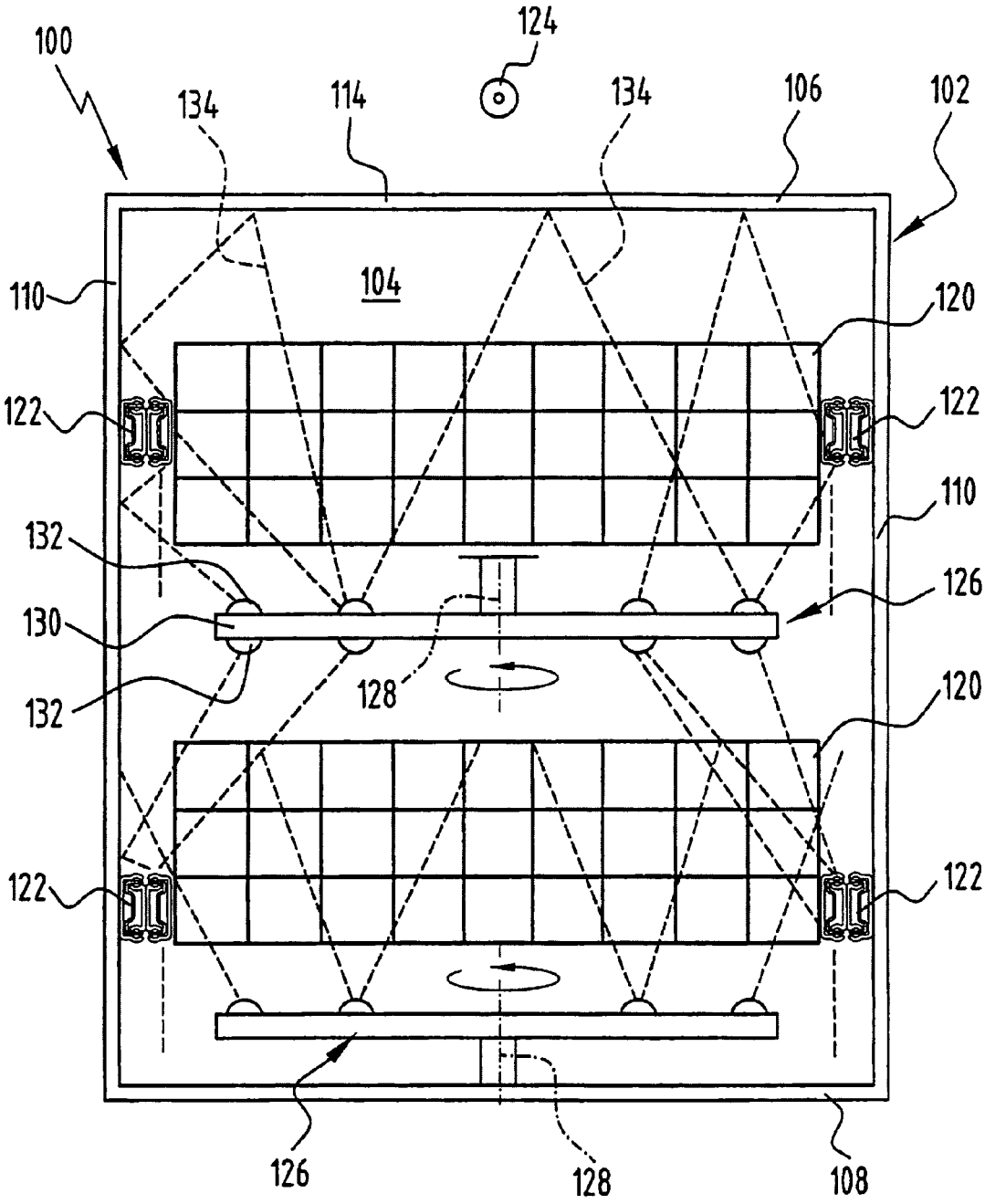
Figures 3, 4:
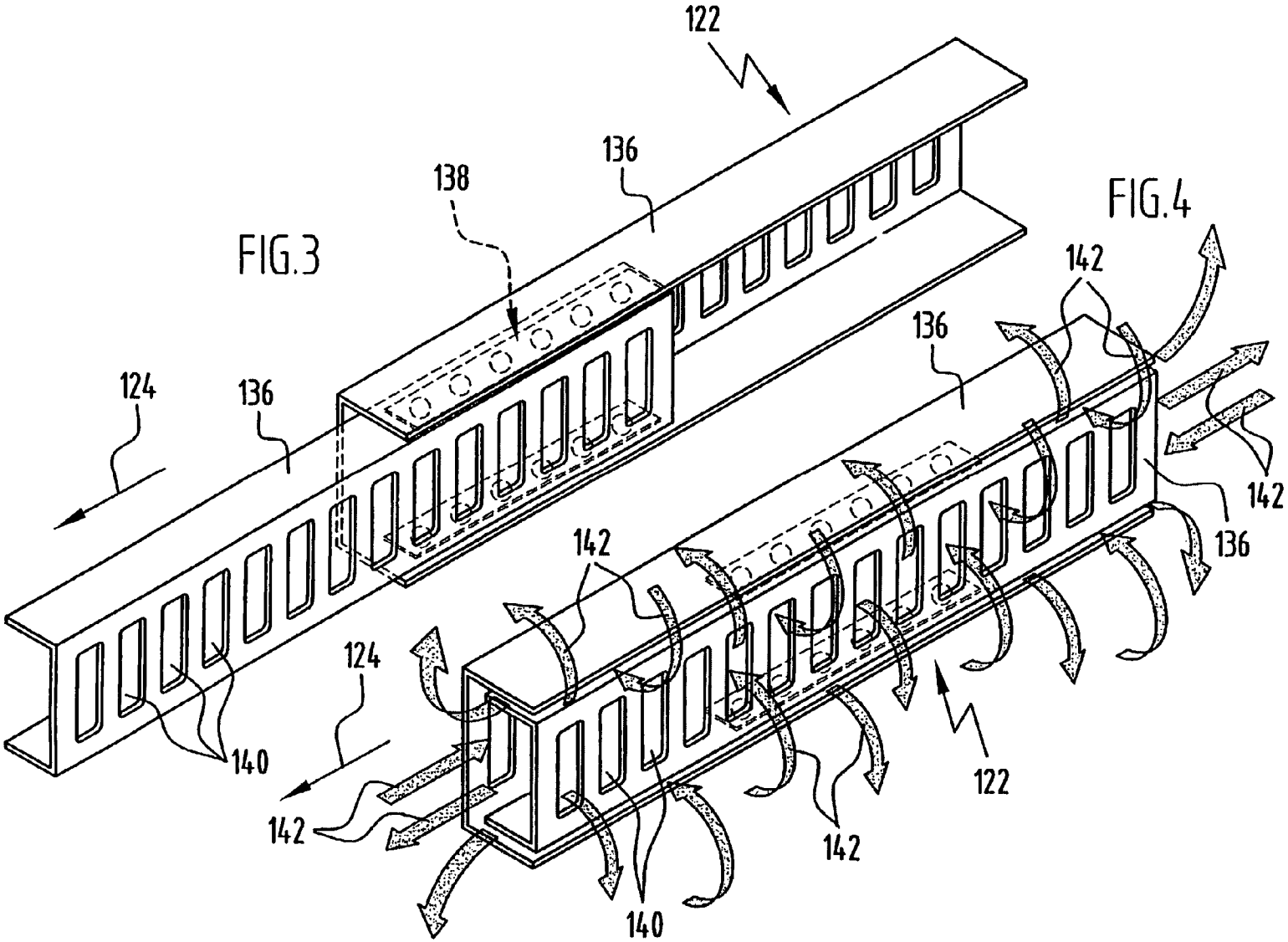
Figure 5:
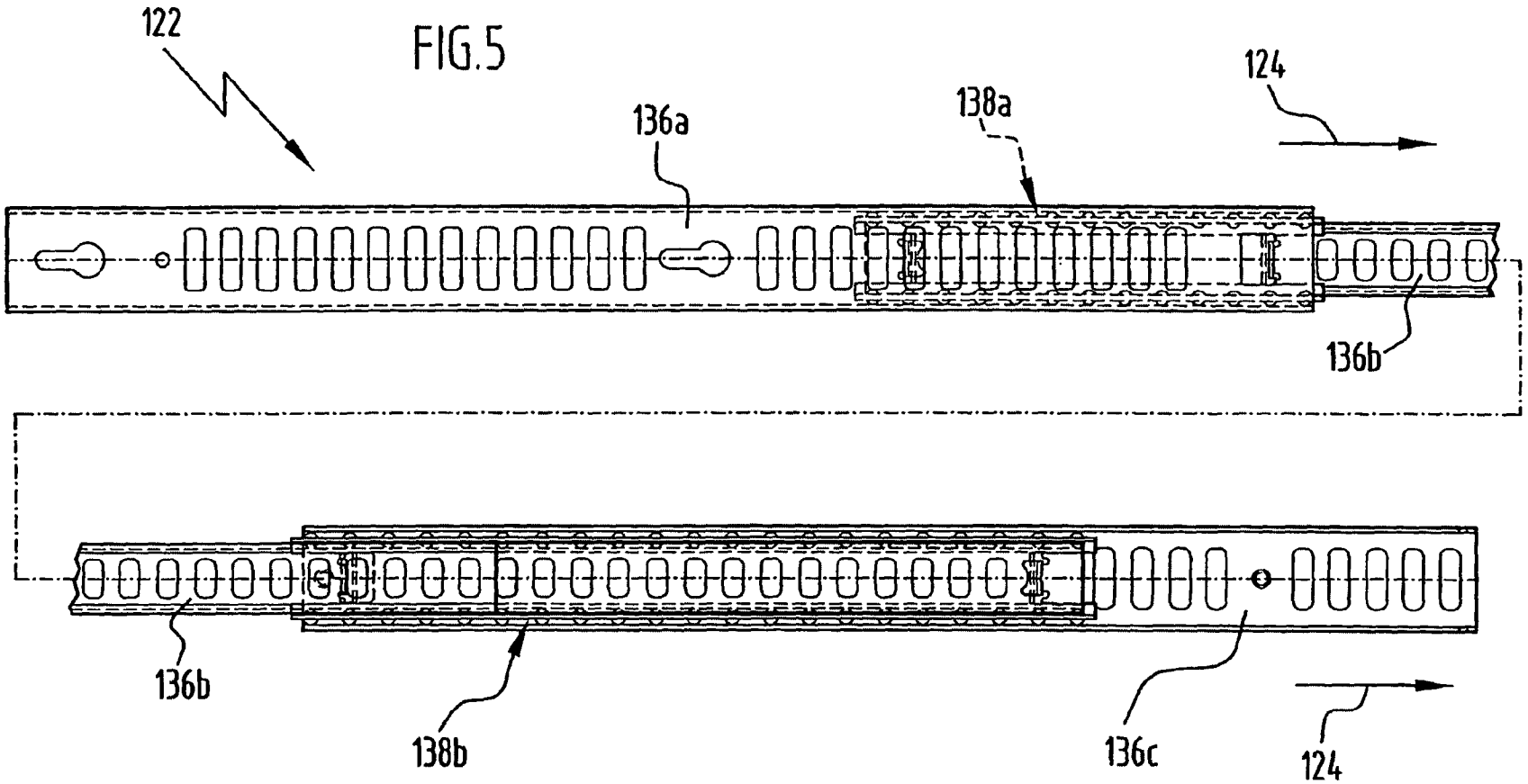
Figure 6:
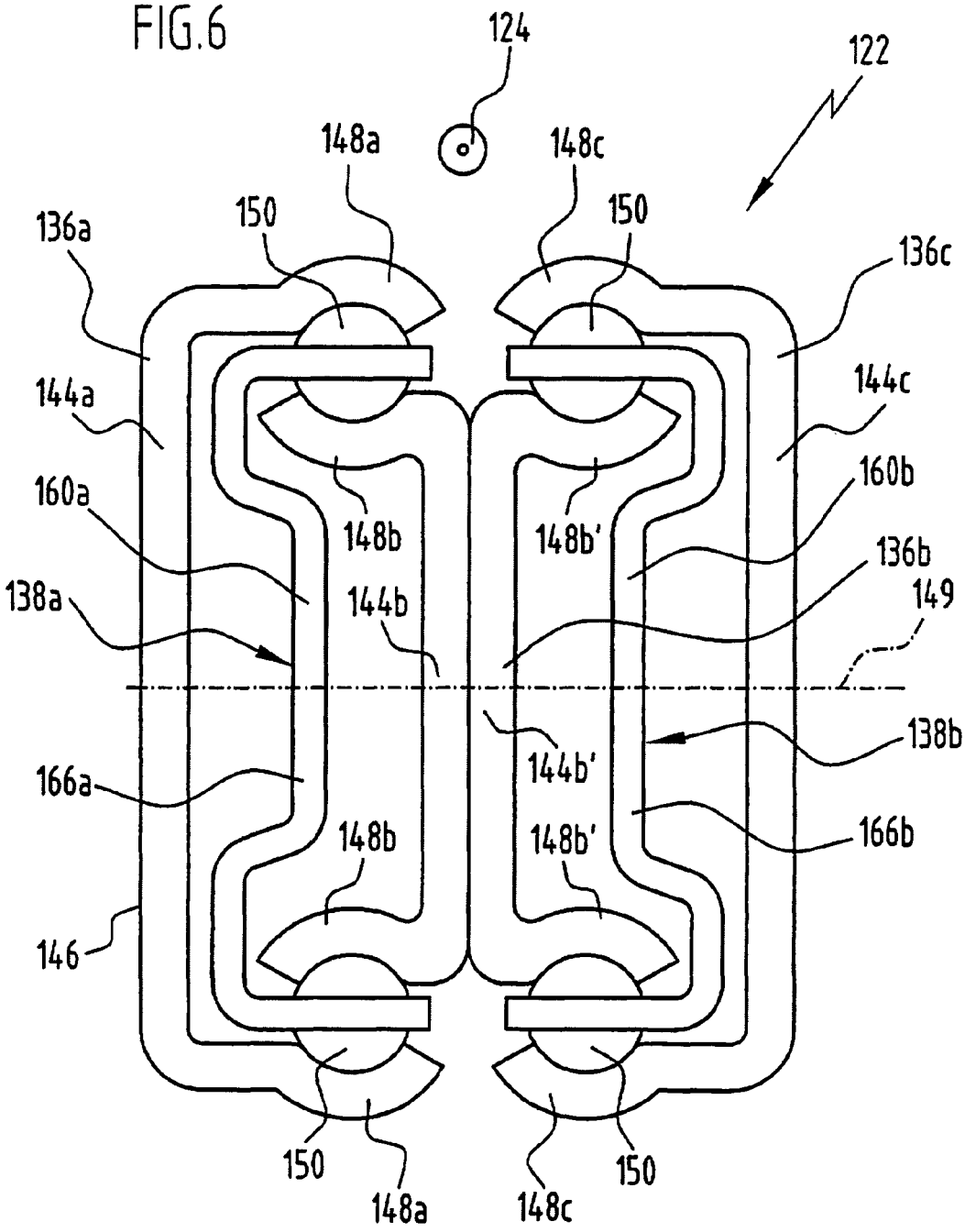
Figure 7:
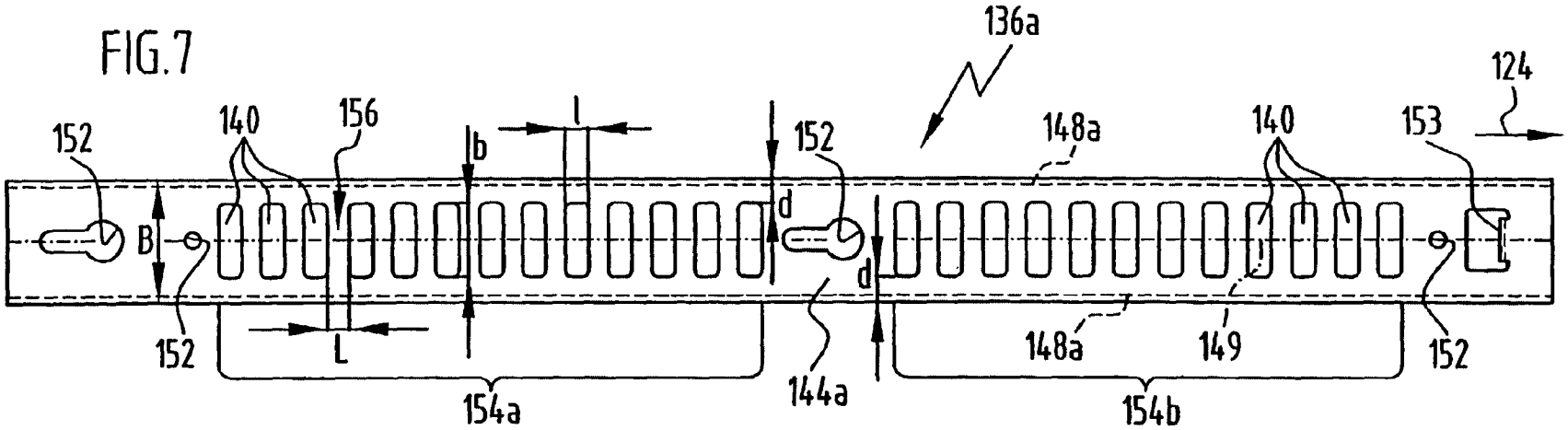
Figure 8:
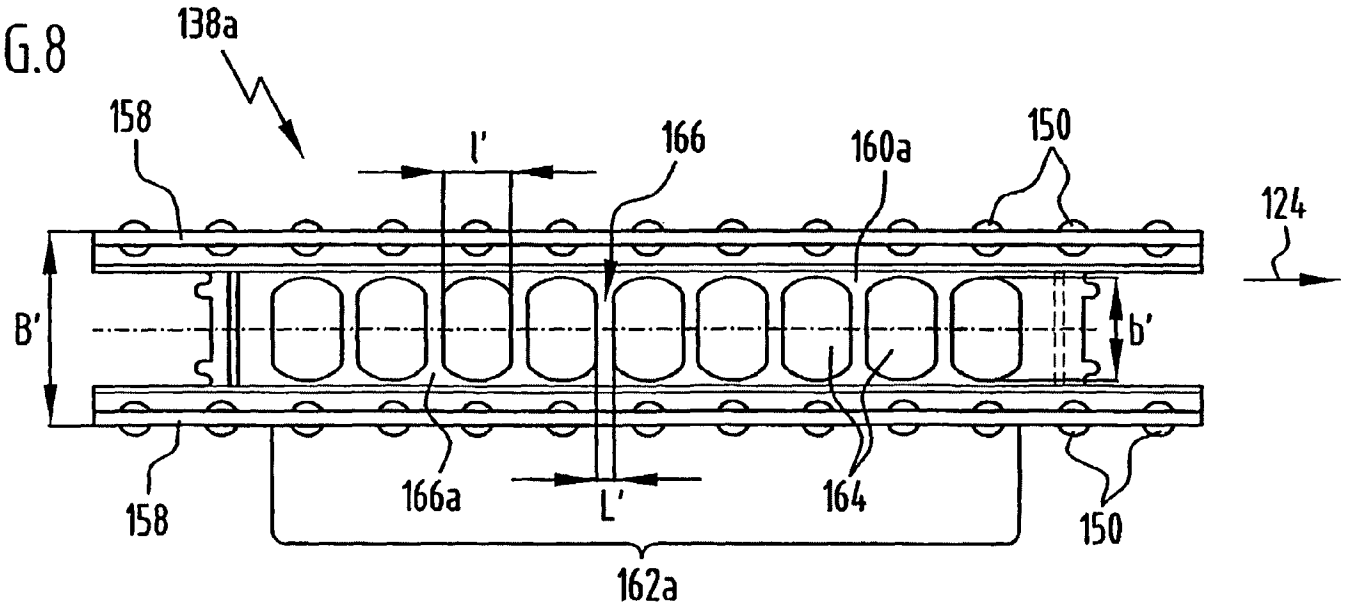
Figure 9:
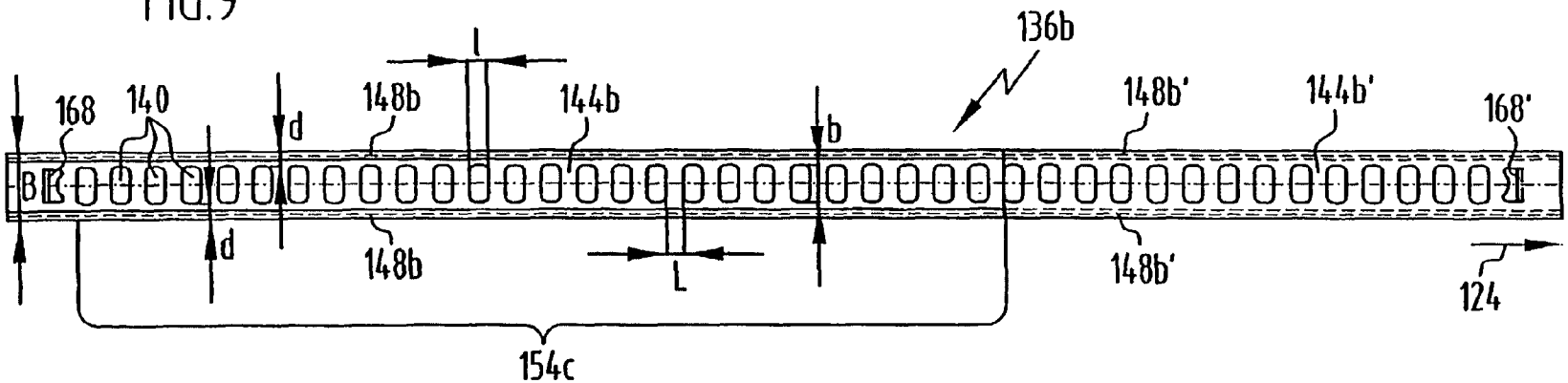
Figure 10:
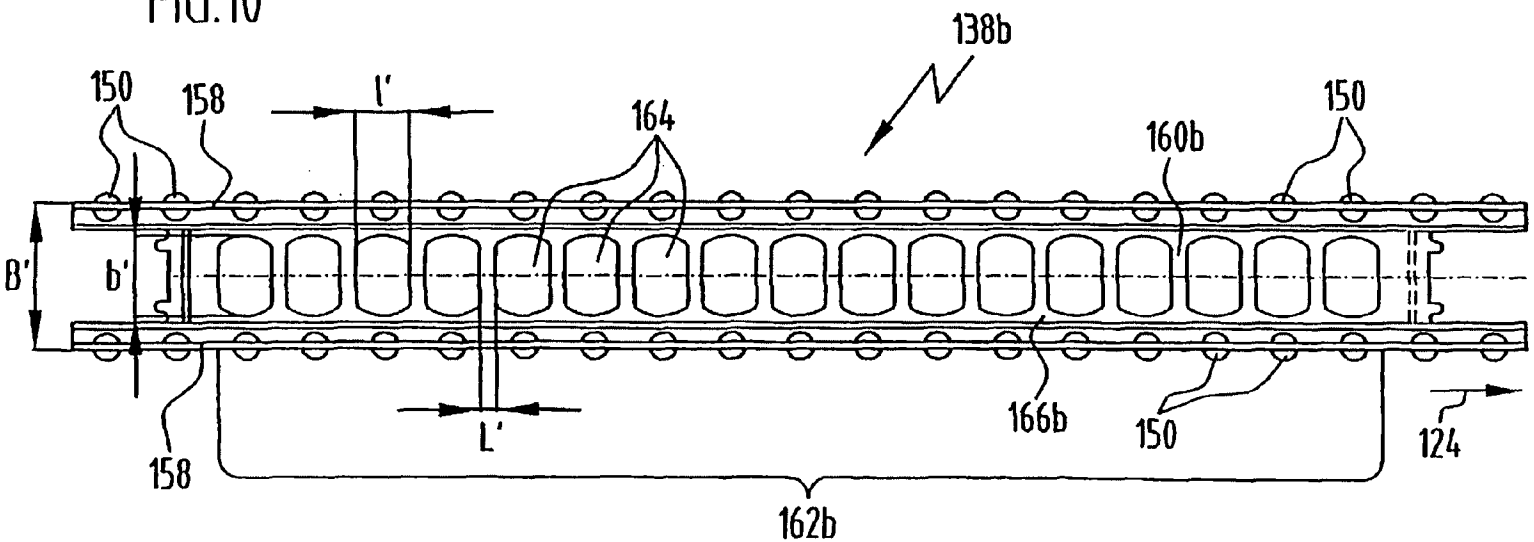
Figure 11:
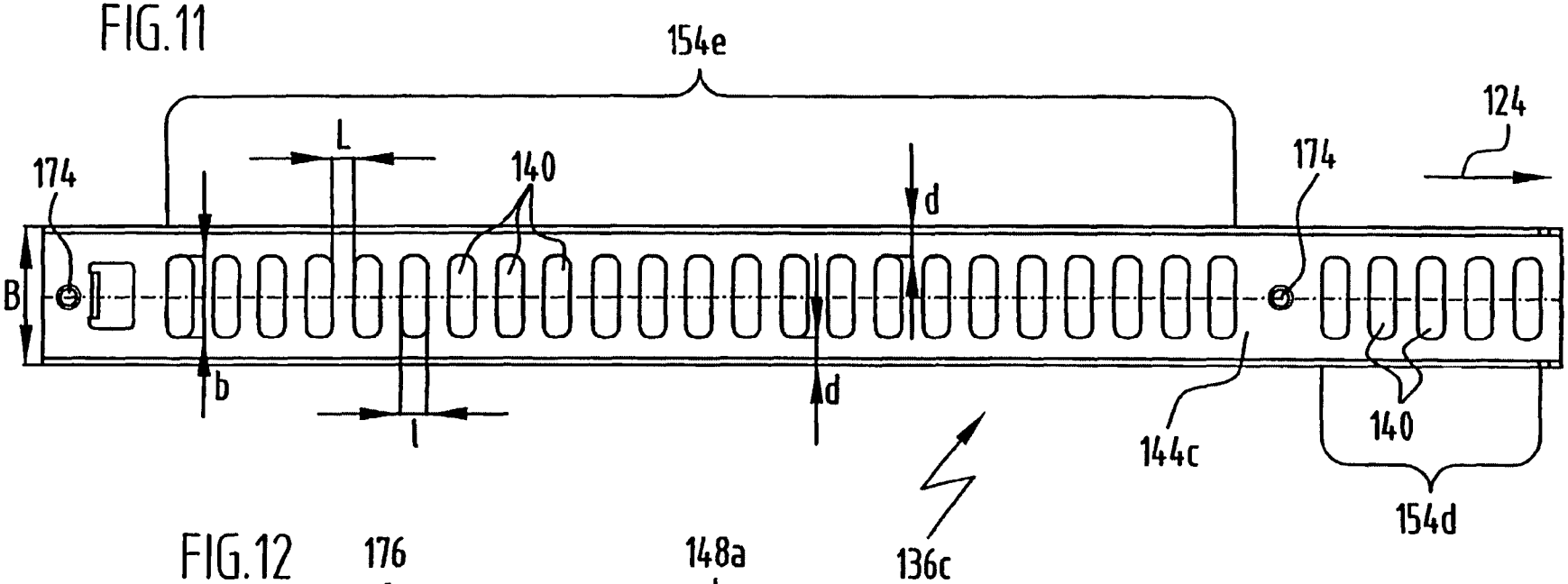
Figure 12:
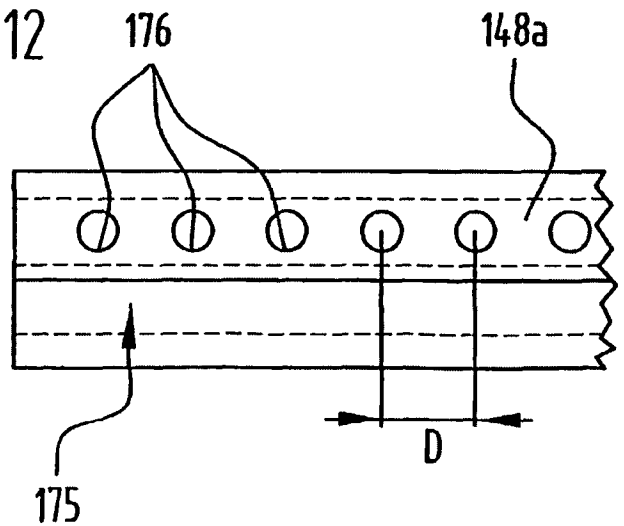

In the drawings:

FIG. 1 shows a schematic perspective illustration of a device, a dishwasher for example, incorporating a chamber through the interior of which, at least on occasion, there is a flow of liquid when the device is in operation, in a state in which a front flap of the device is open and a drawer that is held on side walls of the chamber by means of two drawer guides is pulled out of the interior of the chamber;

FIG. 2 a schematic vertical section through the chamber of the device depicted in FIG. 1 when the device is in operation, wherein a liquid is being flushed through the interior of the chamber;

FIG. 3 a schematic perspective illustration of a drawer guide for the device depicted in FIGS. 1 and 2, in a withdrawn state of the drawer guide;

FIG. 4 a schematic perspective illustration of the drawer guide depicted in FIG. 3, in a pushed-in state of the drawer guide, wherein the drawer guide is being flushed with liquid;

FIG. 5 a schematic side view of a drawer guide for the device depicted in FIGS. 1 and 2 which is in the form of a multiple drawer guide having a guide rail at the corpus side, a guide rail at the drawer side, and a middle guide rail arranged between the corpus-side guide rail and the drawer-side guide rail;

FIG. 6 a schematic cross-section through the drawer guide depicted in FIG. 5;

FIG. 7 a schematic side view of a guide rail at the corpus side of the drawer guide depicted in FIG. 5;

FIG. 8 a schematic side view of a first rolling member assembly for the drawer guide depicted in FIG. 5;

FIG. 9 a schematic side view of a middle guide rail for the drawer guide depicted in FIG. 5;

FIG. 10 a schematic side view of a second rolling member assembly for the drawer guide depicted in FIG. 5;

FIG. 11 a schematic side view of a guide rail at the drawer side of the drawer guide depicted in FIG. 5; and FIG. 12 a schematic plan view of an end region of a rolling member running track of one of the guide rails for the drawer guide depicted in FIG. 5.

Similar or functionally equivalent elements are designated by the same reference symbols in each of the Figures.

A device in the form of a dishwasher for example, and bearing the general reference 100 is illustrated in FIGS. 1 and 2 and it comprises a chamber 102 having an interior 104 which is bounded by a corpus 106 of the chamber 102 and through which a liquid, for example water together with detergent additives, is adapted to flow at least occasionally when the device is in operation.

The corpus 106 comprises a bottom wall 108 from which two parallel, vertical side walls 110 and also a vertical rear wall 112 that connects the side walls 110 together extend upwardly, as well as an upper wall 114 that delimits the interior 104, said corpus being adapted to be closed at its open front side in fluid-tight manner by means of a front flap 118 that is pivotal about a horizontal axis 116.

The interior 104 of the chamber 102 accommodates one or more, two for example, drawers 120 which are in the form of table-ware baskets for example.

As an alternative thereto, the drawers 120 could, for example, be in the form of vessels, bowls, trays, holding devices or the like.

Each of the drawers 120 is held on the two side walls 110 by means of a respective drawer guide 122 in such a manner that (when the front flap 118 is open) it is adapted to be pulled out from the interior 104 of the chamber 102 in a substantially horizontal drawer-withdrawal direction 124 or pushed completely into the interior 104 of the chamber 102 in a direction opposite to the drawer-withdrawal direction 124.

The drawer guides 122 are full withdrawal guides which permit the respectively associated drawer 120 to be substantially completely pulled out from the interior 104 of the chamber 102.

As can be seen from FIG. 2, a plurality, two for example, of spraying devices 126 are arranged in the interior 104 of the chamber 102, each of said spraying devices comprising one or more spraying arms 130 that rotate about a vertical axis of rotation 128 for example and are each provided with a plurality of spray nozzles 132 which are arranged on the upper surface and/or on the lower surface of the respective spraying arm 130 and with the aid of which a liquid is adapted to be sprayed into the space above or below the respective spraying device 126.

In the case of a dishwasher, this liquid is the rinsing liquid which may comprise, in particular, water together with rinsing additives.

The liquid that is sprayed when the device 100 is in operation is indicated by the broken lines 134 in FIG. 2.

The sprayed liquid 134 flows through the drawers 120, which, for example, are in the form of latticework baskets having the articles contained therein for cleaning purposes for example, and possibly through the drawer guides 122, it then collects on the floor of the chamber 102 and flows out from the interior 104 of the chamber 102 through a (not illustrated) discharge opening.

In particular, as is illustrated in FIG. 2, a first spraying device 126 can be arranged between the bottom wall 108 of the chamber 102 and a lower drawer 120, whilst a further spraying device 126 can be arranged between two drawers 120, in particular, near the lower surface of an upper drawer 120.

In order to enable the streams of fluid emerging from the spray nozzles 132 to enter the drawer guides 122 as unhindered as possible and to enable the liquid entering the drawer guide 122 to loosen the residues, in particular the dirt particles, that are deposited on the drawer guides 122 and wash them out from the drawer guides 122, and indeed, with as small a loss of flow power as possible, the guide rails 136 of the drawer guides 122, which are guided upon one another in displaceable manner in the direction of movement of the drawer 124 by means of rolling member assemblies 138, are each provided with a plurality of liquid passage openings 140 which succeed one another in the direction of movement of the drawer 124 and enable the liquid to enter the drawer guide 122 and also enable the liquid (and the dirt particles contained therein) to flow out from the drawer guide 122, as is schematically illustrated in FIGS. 3 and 4.

A drawer guide 122 comprising two guide rails 136 is illustrated in FIG. 3 in the withdrawn state.

In FIG. 4, the drawer guide 122 is illustrated in the fully pushed-in state after the device 100 has been set in operation. In this state, the drawer guide 122 is flushed by the liquid being sprayed in the interior 104 of the chamber 102, the directions of flow of this liquid being schematically indicated in FIG. 4 by means of the arrows 142.

In order to present as little obstruction to the entry and exit of the liquid as possible, the guide rails 136 are preferably formed in such a way that, in the completely pushed-in state of the drawer guide 122, their fluid passage openings 140 are aligned with one another and with the fluid passage openings in a cage for the rolling members which is not illustrated in FIG. 4.

A concrete example of a drawer guide 122 comprising three guide rails, which is particularly suitable for use in a chamber 102 through which liquid flows, is illustrated in detail in FIGS. 5 to 11.

This drawer guide 122 comprises a guide rail **136*a* at the corpus side (see, in particular, FIG. 7), a guide rail 136*c* at the drawer side (see, in particular, FIG. 11) and a middle guide rail 136*b* which is arranged between the corpus-side guide rail 136*a* and the drawer-side guide rail 136*c* (see, in particular, FIG. 9**).

As can best be seen from FIGS. 5 and 6, the middle guide rail **136*b* is guided in displaceable manner on the corpus-side guide rail 136*a* in the direction of movement of the drawer 124 by means of a first rolling member assembly 138*a***.

The drawer side guide rail **136*c* is guided in displaceable manner on the middle guide rail 136*b* in the direction of movement of the drawer 124 by means of a second rolling member assembly 138*b***.

The corpus side guide rail **136*a* is illustrated in detail in FIGS. 6 and 7**.

It comprises a rear rail portion **144*a* having a flat external surface 146 with the aid of which the corpus side guide rail 136*a* rests flatly against one of the side walls 110 of the corpus 106** in the installed state.

A respective running track **148*a* for the rolling members extends away from the lower edge and from the upper edge of the rear rail portion 144*a*, said running track being concavely curved (as seen from the longitudinal centre plane 149 of the corpus side guide rail 136*a*) in order to provide a contact surface and lateral guidance for the rolling members 150 of the first rolling member assembly 138*a*** which are in the form of balls.

As can be seen from FIG. 7, the rear rail portion **144*a* is provided with various mounting holes 152 which serve for mounting the corpus side guide rail 136*a*, in particular, by the passage of mounting means (screws for example) through the rear rail portion 144*a***.

Moreover, the rear rail portion **144*a* is provided with a stop member 153 which cooperates with a cage 166*a* for the rolling members in the first rolling member assembly 138*a* in order to limit the displacement path of the first rolling member assembly 138*a* relative to the corpus side guide rail 136*a***.

Furthermore, in a first partial section **154*a* which extends in the direction of movement of the drawer 124 over approximately a third of the length of the corpus side guide rail 136***a*, and also in a second partial section 154*b* which likewise extends in the direction of movement of the drawer 124 over approximately a third of the length of the corpus side guide rail 136*a*, the rear rail portion 144*a* of the corpus side guide rail 136*a* is provided with a plurality of fluid passage openings 140 which serve for the entry and exit of liquid through the corpus side guide rail 136*a* when the device 100 is in operation The fluid passage openings 140 in the corpus side guide rail 136*a* are formed in such a manner that they are all substantially congruent to one another, follow one another in sequence in the direction of movement of the drawer 124 and are spaced from one another in the direction of movement of the drawer 124.

Each of the fluid passage openings 140 is substantially rectangular with rounded-off corner regions.

In a concrete exemplary embodiment, the extent 1 of each of the fluid passage openings 140 in the direction of movement of the drawer 124 amounts to approximately 5 mm, whilst the extent b of each of the fluid passage openings 140 in a direction perpendicular to the direction of movement of the drawer 124 amounts to approximately 16 mm. The total width B of the rear rail portion 144*a* amounts to approximately 28 mm, and the width L of the web 156 between two successive fluid passage openings 140, i.e. the extent thereof in the direction of movement of the drawer 124, amounts to approximately 5 mm.

It ensues therefrom that the ratio of the surface area of the fluid passage openings 140 to the total surface area of the rear rail portion 144*a* (including the surface areas of the fluid passage openings 140) in the two partial sections 154*a*, 154*b* amounts to approximately 29% in each case.

The distance d of the lower edge of each fluid passage opening 140 from the lower edge of the rear rail portion 144*a* or of the upper edge of each of the fluid passage openings 140 from the upper edge of the rear rail portion 144*a* amounts to approximately 5 mm, i.e. approximately 18% of the width B of the rear rail portion 144*a*.

The rolling members 150, which roll on the rolling member running tracks 148*a* of the corpus side guide rail 136*a*, are held in a respective accommodating hole in an upper or a lower rolling member retaining strip 158, wherein both rolling member retaining strips 158 extend in parallel relative to one another and to the direction of movement of the drawer 124 (see FIG. 8).

The two rolling member retaining strips 158 are connected together by means of a rear cage portion 160*a* which comprises a partial section 162*a* that extends in the direction of movement of the drawer 124 and is provided with a plurality of fluid passage openings 164.

The fluid passage openings 164 are formed in such a manner that they are substantially congruent to one another, follow each other in the direction of movement of the drawer 124 and are spaced from one another in the direction of movement of the drawer 124.

Each of the fluid passage openings 164 is substantially in the form of a rectangle having circular segments at two mutually opposite sides.

In a concrete exemplary embodiment, the extent 1' of each fluid passage opening 164 in the direction of movement of the drawer 124 amounts to approximately 8 mm, whilst the maximum extent b' of each fluid passage opening 164 amounts to approximately 12 mm in a direction perpendicular to the direction of movement of the drawer 124. The width B' of the rear cage portion 160*a* amounts to approximately 22 mm, whilst the width of the web 166 between two successive fluid passage openings 164 in the direction of movement of the drawer 124 amounts to approximately 2 mm.

The ratio of the surface area of the fluid passage openings 164 to the total surface area of the rear cage portion 160*a* in the partial section 162*a* amounts to approximately 38%.

The rear cage portion 160*a* together with the two rolling member retaining strips 158 form the cage 166*a* for the rolling members of the first rolling member assembly 138*a*.

As can be seen from the cross-sectional view of FIG. 6, the rolling members 150 of the first rolling member assembly 138*a* also run on two rolling member running tracks 148*b* of the middle guide rail 136*b* which are respectively opposite to one of the rolling member running tracks 148*a* of the corpus side guide rail 136*a*.

The two running tracks 148*b* for the rolling members are connected together by a rear rail portion 144*b*.

Furthermore, the middle guide rail 136*b* comprises a further rear rail portion 144*b*' whose flat outer face rests on the flat outer face of the rear rail portion 144*b* and is fixed thereto, for example, by welding.

From the lower and the upper edge of the rear rail portion 144*b*', there extends a respective rolling member running track 148*b*' in a direction that is opposed to the direction of the rolling member running tracks 148*b*.

The rolling member running tracks 148*b*' are convexly curved (as seen from the longitudinal centre plane 149 of the middle guide rail 136*b*) in order to form a contact surface and lateral guidance for the rolling members 150 of the second rolling member assembly 138*b*.

As can be seen from FIG. 9, the rear rail portion 144*b*' extends forwardly beyond the rear rail portion 144*b* in the direction of movement of the drawer 124.

In a partial section 154*c* thereof which extends over almost the entire length of the rear rail portion 144*b*, the rear rail portion 144*b* is provided with a plurality of fluid passage openings 140 which succeed one another in the direction of movement of the drawer 124 and are spaced from one another in the direction of movement of the drawer 124.

The fluid passage openings 140 in the rear rail portion 144*b* are formed in such a manner that they are all substantially congruent to one another and have a substantially rectangular shape with rounded-off corners.

In the case of a concrete exemplary embodiment, the elongation 1 of each of the fluid passage openings 140 in the direction of movement of the drawer 124 amounts to approximately 5 mm, whilst the extent b of each of the fluid passage openings 140 in a direction perpendicular to the direction of movement of the drawer 124 amounts to approximately 10 mm. The width B of the rear rail portion 144*b* amounts to approximately 18 mm, whilst the width L of the web 156 between two successive fluid passage openings 140 in the direction of movement of the drawer 124, i.e. the extent of the web 156 in the direction of movement of the drawer 124, amounts to approximately 5 mm in each case. It ensues therefrom, that the ratio of the surface area of the fluid passage openings 140 to the total surface area of the rear rail portion 144*b* in the partial section 154*c* amounts to approximately 28%.

The distance d of the lower edge of each fluid passage opening 140 from the lower edge of the rear rail portion 144*b* or the upper edge of each of the fluid passage openings 140 from the upper edge of the rear rail portion 144*b* amounts to approximately 4 mm, i.e. to approximately 22% of the width B of the rear rail portion 144*b*.

In addition to the fluid passage openings 140, the rear end region of the rear rail portion 144*b* is provided with a stop member 168 which co-operates with the cage 166*a* for the rolling members in the first rolling member assembly 138*a* in order to limit the displacement path of the middle guide rail 136*b* relative to the first rolling member assembly 138*a*.

The rear rail portion 144*b*' is mirror-symmetrical with respect to the rear rail portion 144*b* and is thus likewise provided with fluid passage openings 140 and a stop member 168' which co-operates with a cage 166*b* for the rolling members in the second rolling member assembly 138*b* in order to limit the displacement path of the second rolling member assembly 138*b* relative to the middle guide rail 136*b*.

The two rear rail portions 144*b*, 144*b*' of the middle guide rail 136*b* are fixed together in such a manner that, within the overlapping region of both rear rail portions 144*b*, 144*b*', the fluid passage openings 140 in the rear rail portion 144*b* are aligned with a respective fluid passage opening 140 in the rear rail portion 144*b*'.

The rolling members 150 of the second rolling member assembly 138*b* are in the form of balls and are accommodated in rolling member accommodating openings in two rolling member retaining strips 158 (see FIG. 10) which are connected together by a rear cage portion 160*b* and, together therewith, form the cage 166*b* for the rolling members in the second rolling member assembly 138.

In a partial section 162*b* thereof which extends over virtually the entire length of the rear cage portion 160*b*, said rear cage portion 160*b* is provided with a plurality of fluid passage openings 164 which are substantially congruent to one another, succeed each other in the direction of movement of the drawer 124 and are spaced from one another in the direction of movement of the drawer 124.

In a concrete exemplary embodiment, the fluid passage openings 164 in the rear cage portion 160*b* of the second rolling member assembly 138*b* have exactly the same dimensions and are spaced from one another by the same distance L' as the fluid passage openings 164 in the rear cage portion 160*a* of the first rolling member assembly 138*a*. In the case of this concrete exemplary embodiment, the rear cage portion 160*b* also has the same width B' as the rear cage portion 160*a* of the first rolling member assembly 138*a* so that the ratio of the surface area of the fluid passage openings 164 to the total surface area of the rear cage portion 160*b* in the partial section 162*b* is also of the same size as in the partial section 162*a* of the rear cage portion 160*a* of the first rolling member assembly 138*a*.

The drawer side guide rail 136*c* comprises, as can best be seen from FIG. 6, two running tracks 148*c* for the rolling members which are located opposite a respective one of the rolling member running tracks 148*b*' of the middle guide rail 136*b* and are concavely formed (as seen from the longitudinal centre plane 149 of the drawer side guide rail 136*c*) so that the rolling member running tracks 148*c* of the drawer side guide rail 136*c* provide a contact surface and lateral guidance for the rolling members 150 in the second rolling member assembly 138*b*.

The running tracks 148*c* for the rolling members are connected together by a rear rail portion 144*c*.

As can be seen from FIG. 11, the rear rail portion 144*c* is provided with mounting holes 174 which serve to accommodate mounting means with the aid of which the drawer 120 is connectable to the drawer side guide rail 136*c*.

Furthermore, the rear rail portion 144*c* comprises two partial sections 154*d* and 154*e* which respectively extend in the direction of movement of the drawer 124, namely, over approximately a sixth and over approximately two thirds of the length of the rear rail portion 144*c*.

Each of the partial sections 154*d*, 154*e* of the rear rail portion 154*c* comprises a plurality of fluid passage openings 140 which are substantially congruent to one another, succeed each other in the direction of movement of the drawer 124 and are spaced from one another in the direction of movement of the drawer 124.

In the case of a concrete exemplary embodiment, the fluid passage openings 140 in the rear rail portion 144*c* are of exactly the same dimensions and are spaced from one another in the direction of movement of the drawer 124 by the same distance L as the fluid passage openings 140 in the rear rail portion 144*a* of the corpus side guide rail 136*a*. Since, in the case of this concrete exemplary embodiment, the width B of the rear rail portion 144*c* is the same as the width B of the rear rail portion 144*a* of the corpus side guide rail 136*a*, the ratio of the surface area of the fluid passage openings 140 to the total surface area of the rear rail portion 144*c* in the partial sections 154*d* and 154*e* of the rear rail portion 144*c* is also of the same size as in the partial sections 154*a* and 154*b* of the rear rail portion 144*a* of the corpus side guide rail 136*a*.

In the case of this exemplary embodiment, the distance d between the upper edge or the lower edge of each fluid passage opening 140 and the respective upper edge or lower edge of the rear rail portion 144*c* is also of the same size as for the fluid passage openings 140 in the corpus side guide rail 136*a*.

The guide rails 136*a*, 136*b* and 136*c* are preferably made of a high-grade stainless steel material which offers the advantage of increased resistance to corrosion when dirt-removing detergent additives are employed in the liquid used in the interior 104 of the chamber 102. Moreover, this material reduces the susceptibility to rinsing residues remaining on the drawer guide 122, in particular, to acidic or alkaline food residues.

The cages 166*a*, 166*b* for the rolling members, and the rolling members 150 themselves are preferably also made from a high-grade stainless steel material for the aforementioned reasons.

The radii of the spherical rolling members 150 on the one hand and the radii of curvature of the running tracks 148*a*, 148*b*, 148*b*' and 148*c* for the rolling members on the other are preferably matched to one another in such a manner that each rolling member 150 does not touch each of the rolling member running tracks associated therewith in a line, but merely touches it at a single point.

Due to this single-point contact of the rolling members 150 on the running tracks for the rolling members, there ensues a snow plough effect, i.e. each rolling member 150 furrows through possibly existing deposits on the rolling member running tracks and displaces these deposits to the side away from the rolling member running track concerned. An adverse effect upon the running attributes of the rolling member assemblies 138*a*, 138*b* due to possible dirt deposits on the drawer guides 122 is prevented in this way.

The fluid passage openings 140, 164 in the guide rails or in the cage for the rolling members can be produced by any suitable separation process, in particular, by punching them out or by means of a laser cutting process.

In the case of a variant of the previously described drawer guide 122 for use in the device 100, provision may be made for the respective end regions 175 of the rolling member running tracks 148*a*, 148*b*, 148*b*' and/or 148*c* to be provided with one or with a plurality of fluid passage openings 176 which enable residual liquid to drain off the respective rolling member running track.

Moreover, these passage openings in the end region of a rolling member running track may serve to provide a certain latching effect for one or more rolling members 150 in a withdrawn position of the drawer guide 122. For this purpose, the fluid passage openings 176 in the end region 175 of the rolling member running track concerned are substantially circular in shape, and they are arranged at a distance D from one another which corresponds to the spacing between two rolling members 150 in one of the cages 166*a*, 166*b* for the rolling members.

A plan view of such an end region 175 incorporating fluid passage openings 176 is illustrated in exemplary manner in FIG. 12 on the basis of the rolling member running track 148*a* of the corpus side guide rail 136*a*.

The invention claimed is:

1. A device incorporating a chamber through the interior of which, at least on occasion, there is a flow of liquid or gas when the device is in operation, comprising at least one drawer and at least one drawer guide by means of which the drawer is held on the chamber such that it is displaceable in the direction of movement of the drawer, wherein:

the drawer guide comprises at least one guide rail associated with the drawer and one guide rail associated with the chamber and at least one rolling member assembly with rolling members by means of which one of the guide rails is guided in displaceable manner on another guide rail of the drawer guide in the direction of movement of the drawer and which comprises a cage for the rolling members, at least one of the guide rails of the drawer guide comprises a rear rail portion which includes at least one partial section that extends in the direction of movement of the drawer and is provided with fluid passage openings in such a manner that the liquid or the gas is adapted to flow through the guide rail concerned when the device is in operation, at least one cage for the rolling members of the drawer guide comprises a rear cage portion which includes at least one partial section that extends in the direction of movement of the drawer and is provided with fluid passage openings in such a manner that the liquid or the gas is adapted to flow through the cage for the rolling members when the device is in operation; and in a state of complete insertion of the drawer guide into the interior of the chamber, at least one of the fluid passage openings in at least one of the guide rails and at least one of the fluid passage openings in at least one of the at least one cage for the rolling members are either aligned with one another or at least partly overlap one another.

2. A device in accordance with claim 1, wherein:

a ratio of a surface area of the fluid passage openings in the guide rail to the total surface area of the rear rail portion in the partial section amounts to at least approximately 20%, and/or a ratio of a surface area of the fluid passage openings in the cage for the rolling members to the total surface area of the rear cage portion in the partial section amounts to at least approximately 20%.

3. A device in accordance with claim 2, wherein:

the ratio of the surface area of the fluid passage openings in the guide rail to the total surface area of the rear rail portion in the partial section amounts to at least approximately 25%, and/or the ratio of the surface area of the fluid passage openings in the cage for the rolling members to the total surface area of the rear cage portion in the partial section amounts to at least approximately 25%.

4. A device in accordance with claim 3, wherein:

the ratio of the surface area of the fluid passage openings in the guide rail to the total surface area of the rear rail portion in the partial section amounts to at least approximately 30%, and/or the ratio of the surface area of the fluid passage openings in the cage for the rolling members to the total surface area of the rear cage portion in the partial section amounts to at least approximately 30%.

5. A device in accordance with claim 4, wherein:

the ratio of the surface area of the fluid passage openings in the guide rail to the total surface area of the rear rail portion in the partial section amounts to at least approximately 40%, and/or the ratio of the surface area of the fluid passage openings in the cage for the rolling members to the total surface area of the rear cage portion in the partial section amounts to at least approximately 40%.

6. A device in accordance with claim 1, wherein:

a ratio of a surface area of the fluid passage openings in the guide rail to the total surface area of the rear rail portion in the partial section amounts to at most approximately 90%, and/or a ratio of a surface area of the fluid passage openings in the cage for the rolling members to the total surface area of the rear cage portion in the partial section amounts to at most approximately 90%.

7. A device in accordance with claim 6, wherein:

the ratio of the surface area of the fluid passage openings in the guide rail to the total surface area of the rear rail portion in the partial section amounts to at most approximately 80%, and/or the ratio of the surface area of the fluid passage openings in the cage for the rolling members to the total surface area of the rear cage portion in the partial section amounts to at most approximately 80%.

8. A device in accordance with claim 1, wherein at least one of the partial sections provided with fluid passage openings extends over at least one third of a length of the rear rail portion or the rear cage portion.

9. A device in accordance with claim 1, wherein a sum of lengths of the partial sections provided with fluid passage openings is greater than approximately two thirds of the total length of the rear rail portion or the rear cage portion.

10. A device in accordance with claim 1, wherein at least one partial section of one of the guide rails of the drawer guide comprises fluid passage openings whose lateral distance from at least one lateral edge of an associated rear rail portion of the guide rail concerned is less than approximately a quarter of a width of the rear rail portion.

11. A device in accordance with claim 1, wherein the at least one partial section of the rear rail portion or of the rear cage portion comprises at least three fluid passage openings which are substantially congruent to one another.

12. A device in accordance with claim 1, wherein an extent of each of the fluid passage openings in the rear rail portion or in the rear cage portion is at most approximately 5 mm in at least one direction in which it extends.

13. A device in accordance with claim 1, wherein an extent of each of the fluid passage openings in the rear rail portion or in the rear cage portion is at most approximately 5 mm in the direction of movement of the drawer.

14. A device incorporating a chamber through the interior of which, at least on occasion, there is a flow of liquid or gas when the device is in operation, comprising at least one drawer and at least one drawer guide by means of which the drawer is held on the chamber such that it is displaceable in the direction of movement of the drawer, wherein:

the drawer guide comprises at least one guide rail associated with the drawer and one guide rail associated with the chamber and at least one rolling member assembly with rolling members by means of which one of the guide rails is guided in displaceable manner on another guide rail of the drawer guide in the direction of movement of the drawer and which comprises a cage for the rolling members, at least one of the guide rails of the drawer guide comprises a rear rail portion which includes at least one partial section that extends in the direction of movement of the drawer and is provided with fluid passage openings in such a manner that the liquid or the gas is adapted to flow through the guide rail concerned when the device is in operation, at least one cage for the rolling members of the drawer guide comprises a rear cage portion which includes at least one partial section that extends in the direction of movement of the drawer and is provided with fluid passage openings in such a manner that the liquid or the gas is adapted to flow through the cage for the rolling members when the device is in operation, and when the drawer guide is pushed completely into the interior of the chamber, at least one of the fluid passage openings in at least one of the guide rails and at least one of the fluid passage openings in at least one of the at least one cage for the rolling members are aligned with one another.

15. A device in accordance with claim 14, wherein, when the drawer guide is pushed completely into the interior of the chamber, a plurality of fluid passage openings in the guide rail are aligned with a respective fluid passage opening in the cage for the rolling members.

16. A device in accordance with claim 15, wherein, when the drawer guide is pushed completely into the interior of the chamber, substantially all of the fluid passage openings in the guide rail are aligned with a respective fluid passage opening in the cage for the rolling members.

17. A device in accordance with claim 1, wherein at least one of the guide rails of the drawer guide comprises a rolling member running track which is provided with at least one fluid passage opening.

18. A device in accordance with claim 1, wherein at least one rolling member assembly of the drawer guide comprises rolling members in the form of balls.

19. A device in accordance with claim 1, wherein at least one rolling member assembly of the drawer guide comprises rolling members which are each in single-point contact with a rolling member running track of a guide rail of the drawer guide that is associated with the rolling members.

20. A device in accordance with claim 1, wherein the drawer guide comprises at least one further guide rail arranged between the guide rail associated with the drawer and the guide rail associated with the chamber.

21. A device in accordance with claim 1, wherein the drawer guide is a full withdrawal guide, by means of which the drawer is withdrawable substantially completely from the interior of the chamber.

22. A device in accordance with claim 1, wherein the device is a washing machine or a dishwasher.

* * * * *